US006148469A

United States Patent [19]

Irven

[11] Patent Number: 6,148,469

[45] Date of Patent: Nov. 21, 2000

[54] ADJUSTABLE HANDLE FOR EDGING PAINT ROLLER

[76] Inventor: Neil Irven, R.R. #4, Crysler, Ontario, Canada, K0A 1R0

[21] Appl. No.: 09/264,019

[22] Filed: Mar. 8, 1999

[30] Foreign Application Priority Data

Mar. 6, 1998 [CA] Canada ..... 2231454

[51] Int. Cl.[7] ..... B05C 17/02

[52] U.S. Cl. ..... 15/230.11; 15/144.1; 492/13

[58] Field of Search ..... 15/144.1, 144.2, 15/230.11; 492/13, 19

[56] References Cited

U.S. PATENT DOCUMENTS 5,207,755 5/1993 Ampian ..... 15/230.11

FOREIGN PATENT DOCUMENTS 525941 2/1954 France ..... 15/230.11

*Primary Examiner*—Randall E. Chin

*Attorney, Agent, or Firm*—Robert G. Hendry

[57] ABSTRACT

An adjustable handle for a paint roller to facilitate holding the roller with its axis vertical as would be required for moving the roller in a horizontal path adjacent a ceiling. A second adjustment is provided to set the handle at an appropriate angle from the plane of the contact surface. The adjustable handle includes an index wheel on an extension of the roller shaft. A connector secured to the handle and mounted on the shaft extension is urged toward the index wheel by a spring. Two pins on the connector selectively engage holes in the index wheel. The connector is moved away from the index wheel against the urging of the spring to disengage one or other of the pins so that the angular adjustment of the connector and the index wheel can be changed and the selected pin relocated in a selected hole in the index wheel.

8 Claims, 6 Drawing Sheets

ADJUSTABLE HANDLE FOR EDGING PAINT ROLLER

FIELD OF THE INVENTION

The present invention relates to paint rollers and more particularly to adjustable handles for paint rollers to provide angular adjustment of the rollers in relation to the handle.

BACKGROUND OF THE INVENTION

A paint roller particularly suited for applying paint in corners or along edges of walls or ceilings without applying unwanted paint to adjacent surfaces is described in applicant's U.S. Pat. No. 5,412,832. This edging paint roller includes a conical roller body rotating on a shaft angularly disposed to the roller and mounted in an open end of the roller. The adjustable handle shown for use with the edging roller includes locking means so that handle can be set to an appropriate angle from the plane of the contact surface. The present invention seeks to provide a simple locking device for adjusting this angular relationship to the wall surface while also providing angular positioning of the handle with respect to the roller to facilitate holding the roller with the axis vertical to provide a horizontal path for the roller as would be required to paint the upper edge of a wall adjacent a ceiling.

Prior attempts to provide an adjustable handle for a paint roller include patents such as U.S. Pat. No. 3,273,192; U.S. Pat. No. 3,408,676; U.S. Pat. No. 4,528,714, and U.S. Pat. No. 4,089,082 directed to locking the paint roller in an angularly adjusted position. The paint roller handles of these prior patents are limited to angular adjustability in only one direction. Although the swivel joint of U.S. Pat. No. 3,866,257 provides universal adjustment, it is not designed to adjust the angular relationship of the roller handle to the plane of the work surface required for optimum performance of the edging paint roller. The universally adjustable paint roller of U.S. Pat. No. 5,207,755 while providing adjustment in at least two directions, is not particularly suitable for use with the edging paint roller and would not be as inexpensive, rugged and reliable as the present invention.

Accordingly, the present invention provides a paint roller comprising: a paint roller cover on a tubular support, an axial shaft, spaced apart support discs for supporting the shaft, a shaft extension extending parallel to an outer face of the tubular support, an index wheel secured to the shaft extension, a connector rotatably mounted on the shaft extension and urged toward the index means by resilient means, a handle secured to the connector and at least one pin on the connector for releasably engaging the index wheel means for adjustably positioning the connector and the handle relative to the roller.

DESCRIPTION OF THE DRAWINGS

In the accompanying drawings which illustrate embodiments of the invention.

DESCRIPTION OF THE INVENTION

Figure 6:
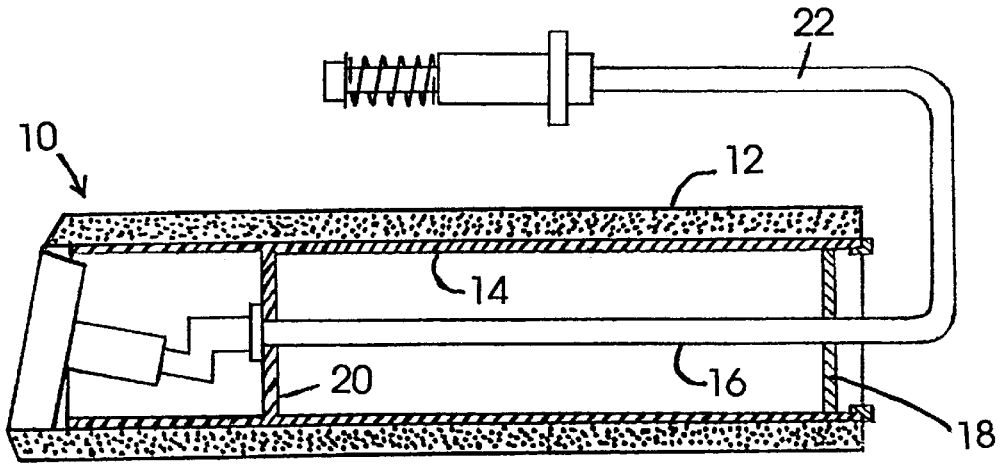
FIG. 6 is a sectional side elevational view of the paint roller of FIG. 2.

Referring now in detail to the drawings an edging paint roller assembly is shown generally at 10 in FIG. 1 and includes a paint roller cover 12 of suitable stretchable material to be described below and a tubular support 14. An axial shaft 16 extends through suitable apertures in a support member 18 at one end of the tubular support and through a second support member 20 spaced from the second end of the tubular support 14 as shown in FIG. 6. The shaft 16 has right angle bends to form a shaft extension 22 parallel with the outer face of the tubular support 14 of the roller 10.

Figure 1:
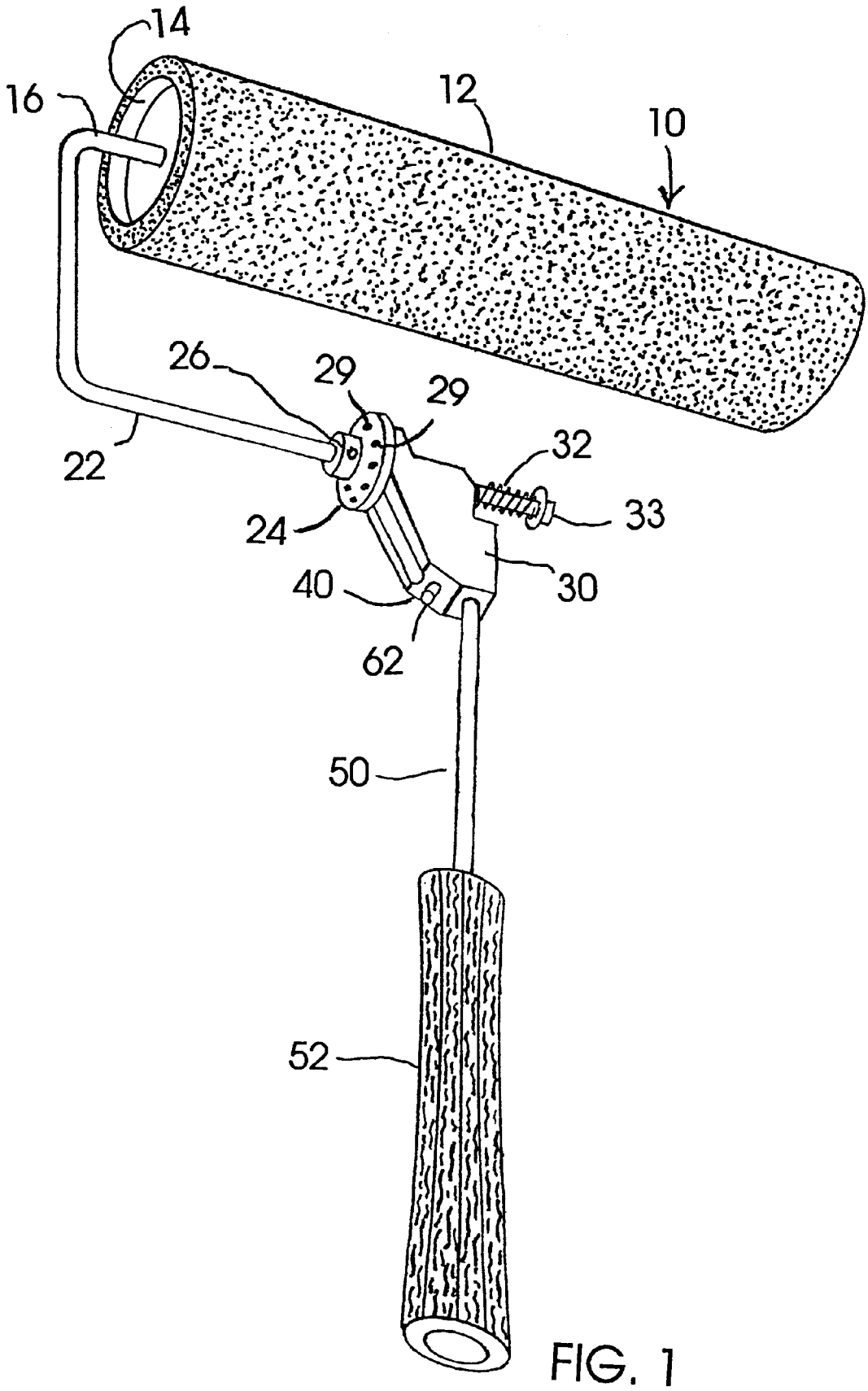
FIG. 1 is a perspective view of the adjustable handle and edging paint roller in accordance with one embodiment of the invention.

As shown more clearly in FIG. 1 an index wheel 24 having apertures 29 spaced therearound is secured to the shaft extension 22 as by a set screw 26 which prevents relative rotation on the shaft extension 22. The shaft 22 also extends through a wedge shaped connector 30 which is urged against the index wheel 24 by resilient means such as a helical spring 32 held in place by a retaining element 33.

The connector 30 has top and bottom walls 34 and 36 and a pair of side walls 38 and 39 defining a wedge shaped cavity 40 and an aperture 42 through which the shaft extension 22 projects.

The side wall 40 is provided with a blind aperture or bore 48 to receive a metal shaft 50 of a conventional synthetic plastic paint roller handle 52. The connector is preferably molded of suitable plastic material and secured to the shaft 50 in the same manner as the handle 52.

It will be noted that the connector 30 has a first integrally formed pin 60 on the wall 38 and a second integrally formed pin 62 on the wall 40. The pins 60 and 62 are adapted to be received in apertures 64 provided about the periphery of the index wheel 24.

Figure 5:
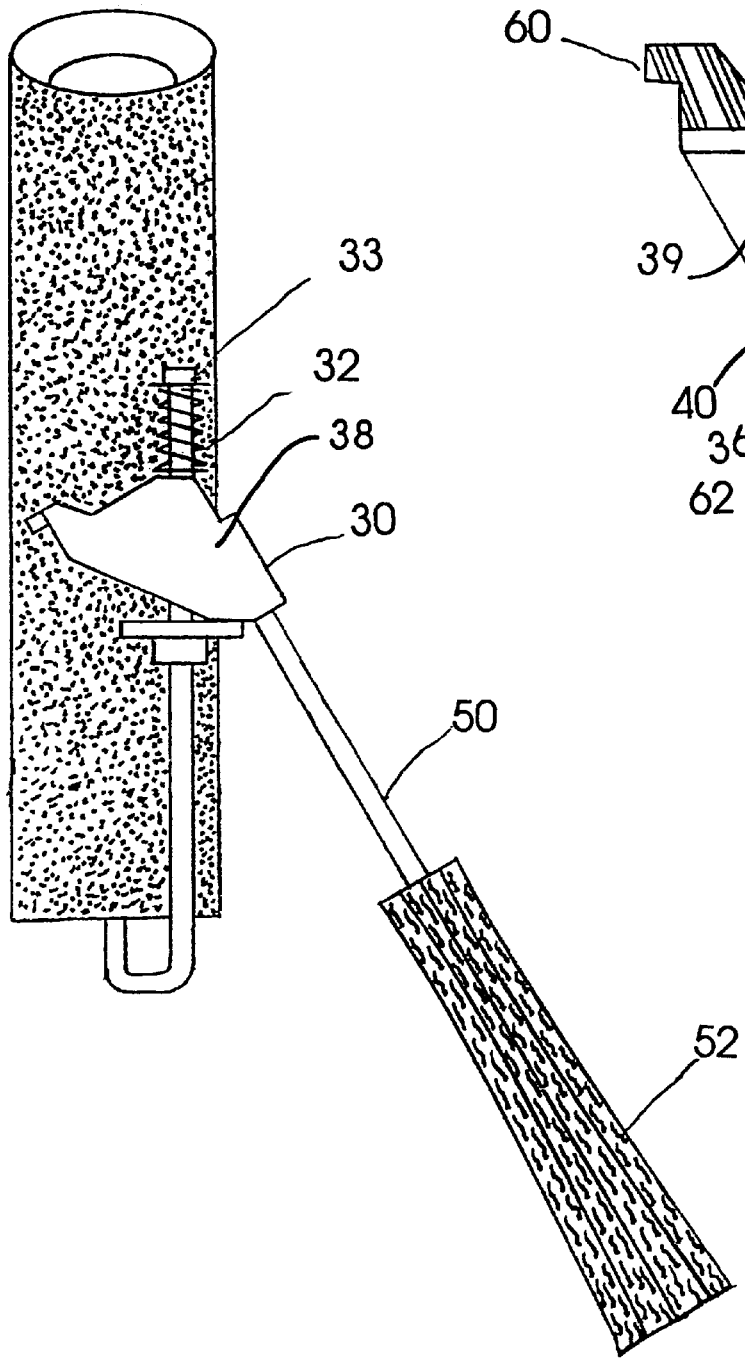
FIG. 5 is a perspective view of the roller handle adjusted so that the axis of the roller is vertical.
Figure 7:
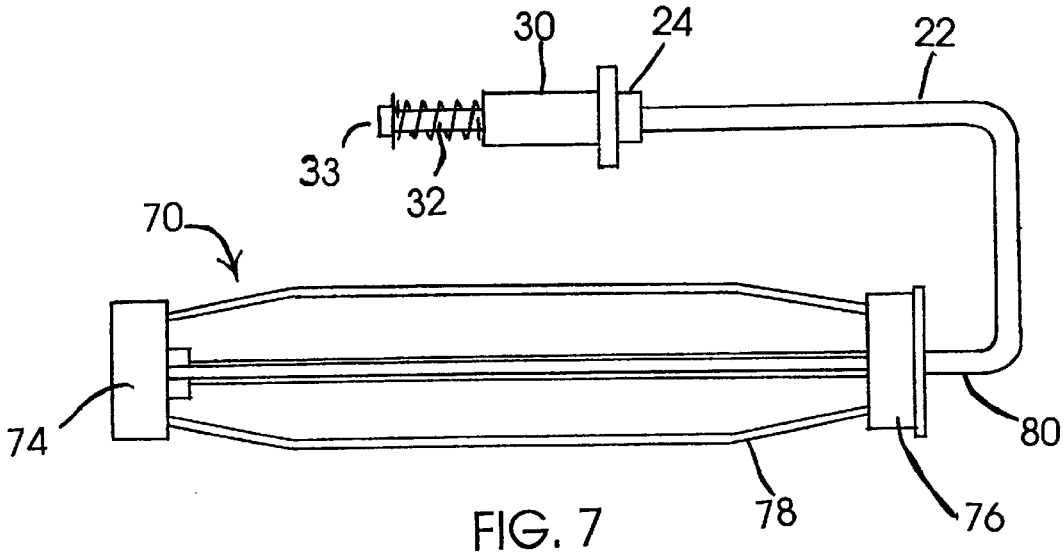
FIG. 7 is a side elevational view of the adjustable handle of this invention on a conventional paint roller.

An adjustable handle 52 as shown in FIG. 5 may be used with a conventional roller 70 shown in FIG. 7, provided with a shaft extension 22. The conventional roller 70 has circular ends 74 and 76 held in position by four axially extending wires 78 space circumferentially about the circular ends 74 and 76. An axial shaft 80 extends through centrally located apertures (not shown) in the circular ends 74 and 76 and is secured for rotation with limited axial movement in a known manner. The shaft 80 is provided with a shaft extension 22 to receive the handle 52 connector 30, index wheel 24 and spring 32 as described above with reference to FIG. 5.

Figure 2:
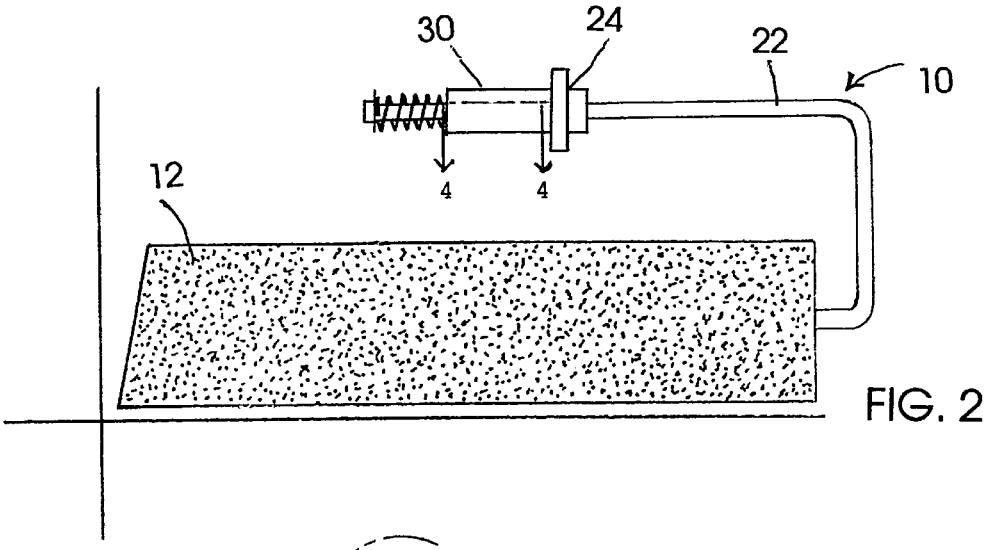
FIG. 2 is a side view of the paint roller of FIG. 1.
Figure 3:
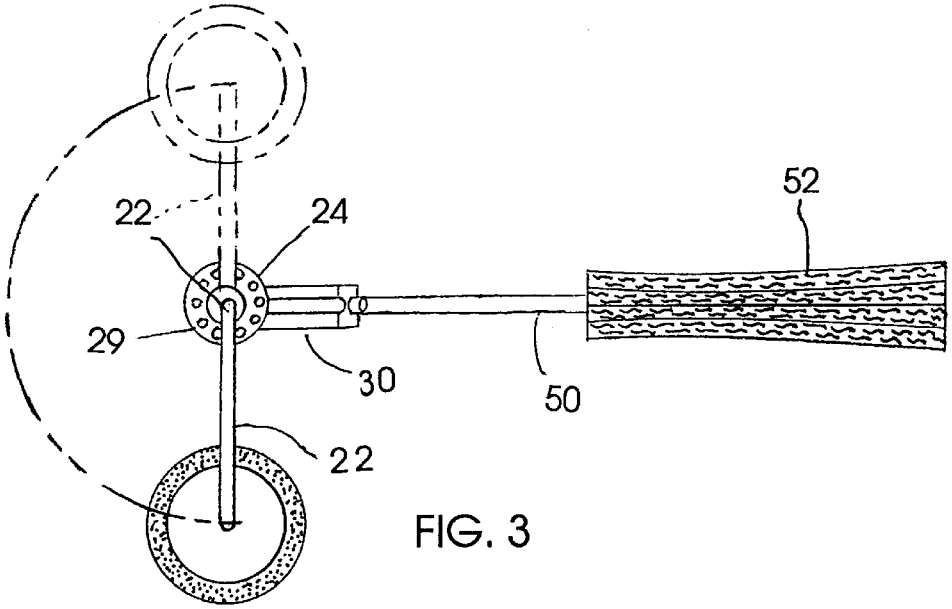
FIG. 3 is an end view showing an alternative position of the roller with respect to the handle.
Figure 4:
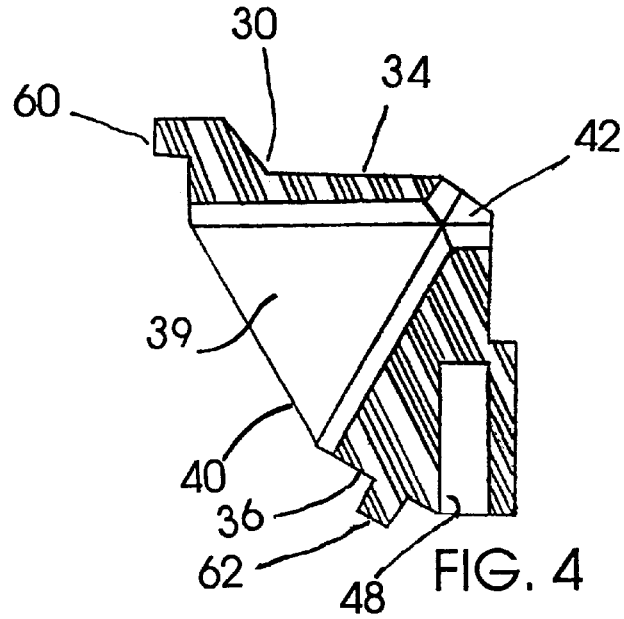
FIG. 4 is a sectional view taken along the line 4—4 of FIG. 2.

The adjustable handle 52 as shown in FIGS. 2 and 3 when used with an edging roller 10 can be adjusted to provide the optimum taper of the end of the roller 12. When the roller 10 is used to apply paint in a horizontal path, as shown in FIGS. 4 and 5, the pin 62 engages the index wheel 24 to provide angular displacement as well as axial adjustment of the handle 52 with respect to the shaft extension 22.

The edging roller 10 shown more clearly in FIG. 6 is described in detail in Applicant's U.S. Pat. No. 5,412,832. Briefly stated, the edging roller 10 has a roller cover 12, a tubular support 14, an axial shaft 16, and support members 18 and 20 for the axial shaft 16. In order to provide an angularly disposed end 21 on the edging roller 10, a link 23 and an angularly disposed shaft 25 secured to the shaft 16 rotatably supports a conical wheel 27.

Figure 8:
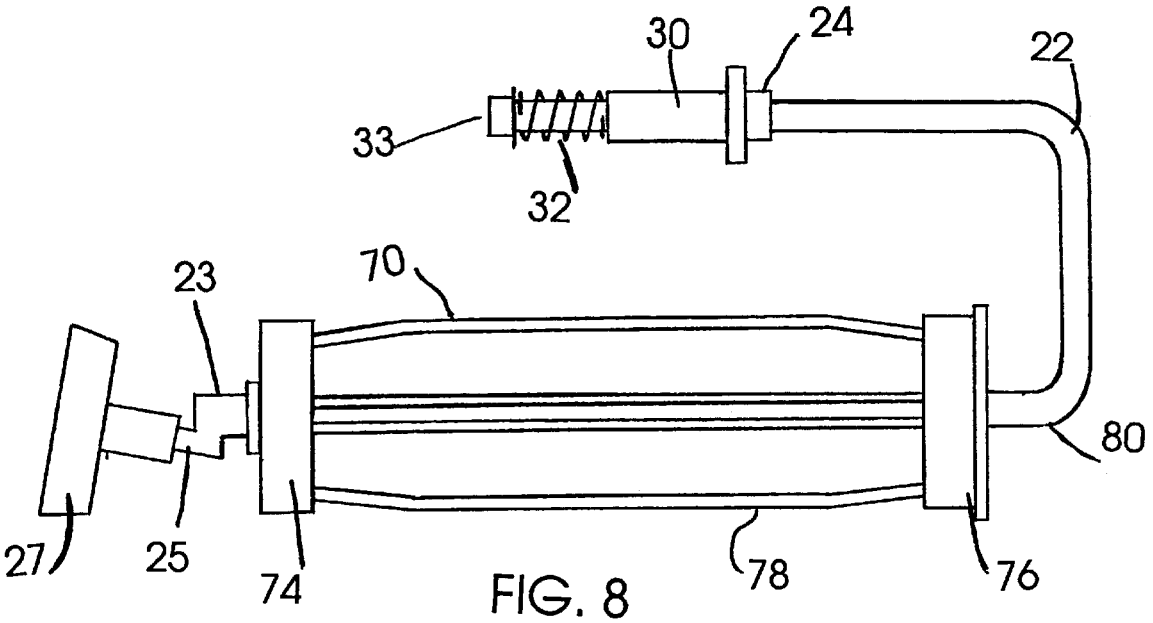
FIG. 8 is a side elevational view of the adjustable handle of this invention on a paint roller for use as an edging paint roller.

In FIG. 8 a cage type roller 70 is shown having ends 74 and 76 interconnected by wires 78 rotatably supporting the shaft 80. The roller 70 is provided with the link 23, angularly disposed shaft 25 and rotatable conical wheel 27 described with reference to FIG. 6.

Figure 9:
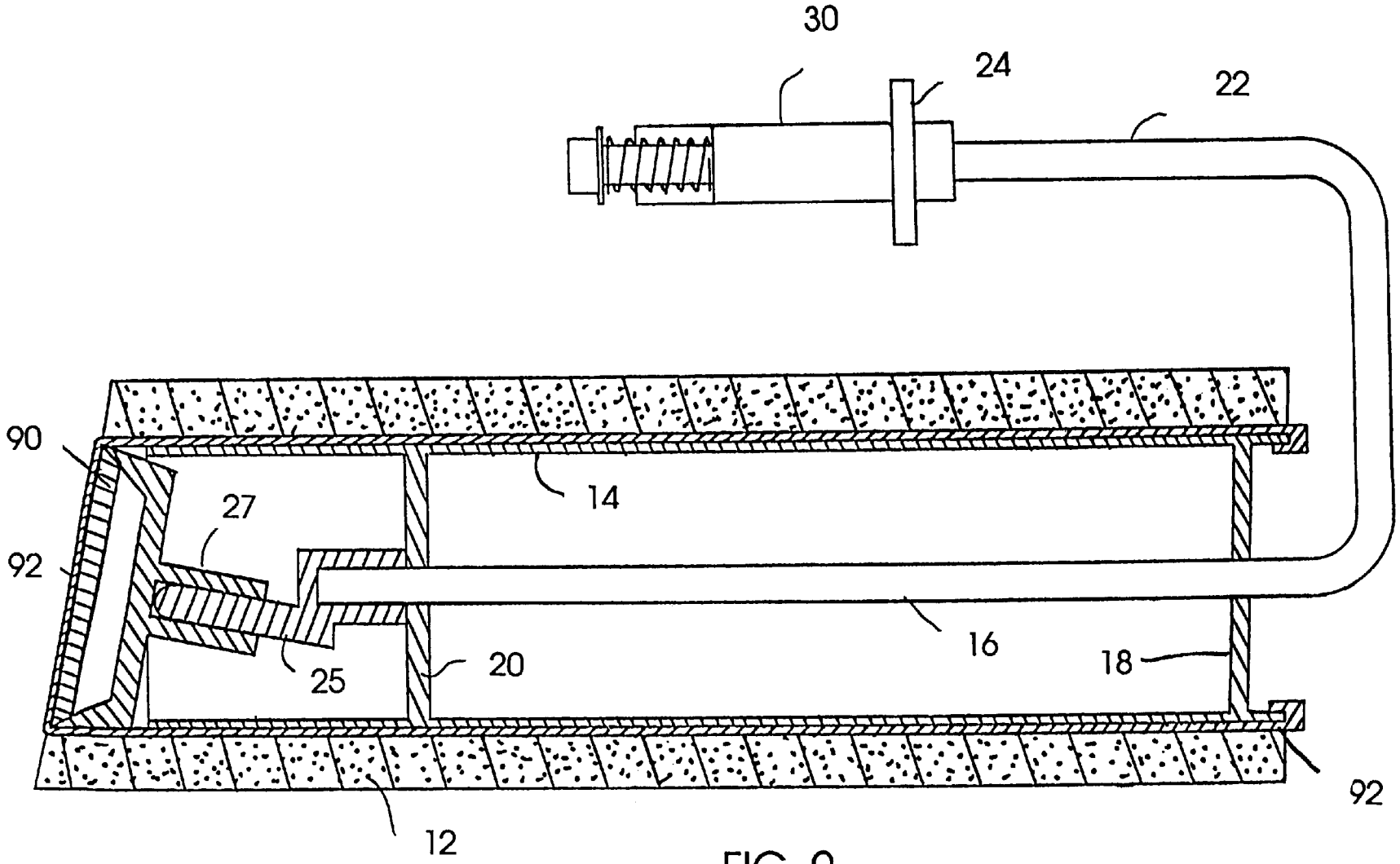
FIG. 9 is a cross sectional view of the sponge type roller cover secured to the edging paint roller.

The edging roller 10 shown in FIG. 9 has a sponge type roller cover 12 on a tubular support 14. The roller 12 is similar to the roller shown in FIG. 6. The shaft 25 extends into the conical wheel 27. The roller 10 of FIG. 9 may also be provided with an intermediate tubular synthetic rubber layer 92 between the sponge type roller cover 12 and the tubular support 14. The tubular rubber layer 92 which is preferably a thin flexible latex material has a closed end secured to centering means such as a disc 90 adapted to engage the conical wheel 27.

In use the shaft 50 is set at any desired angle relative to the roller 12 by moving the connector 30 away from the index wheel 24 so as to disengage the pin 60 of the connector 30 from the index wheel 24. The helical spring 32 is compressed by this movement of the connector 30 until a new position is selected and then the spring 32 urges the connector 30 toward the index wheel 24 so that the pin 60 engages the selected aperture 29 of the index wheel 24.

Adjustment of the roller handle 52 to facilitate holding the roller 12 with the axis of the axial shaft 16 vertical as shown in FIGS. 5 and 9 is carried out by moving the connector 30 away from the index wheel 24 against the urging of the helical spring 32 so that the pin 62 can be moved into engagement with a selected aperture 29 in the index wheel 24.

When the adjustable handle 52 is provided on an edging roller the angle of the shaft extension 22 with respect to the surface to be painted is also adjusted to optimise the angle of the conical wheel to the surface adjacent to the surface to be painted.

The embodiments of the invention in which an exclusive property or privilege is claimed are defined as follows:

1. An adjustable handle for a paint roller having, a paint roller cover;

a tubular support for the roller cover;

an axial shaft, spaced apart support discs for the axial shaft; and a shaft extension extending parallel to an outer face of the tubular support, the adjustable handle comprising; index wheel means secured to the shaft extension;

a connector secured to the handle and rotatably mounted on the shaft extension adjacent the index wheel means:

means for urging the connector toward the index wheel means; and means on the connector for releasably engaging the index wheel means for adjustably positioning the connector and the handle relative to the roller.

2. An adjustable handle as claimed in claim 1 wherein the shaft extension extends through the connector and is movable relative to the axis of the shaft extension so that the second means on the connector for releasably engaging the index wheel means provides adjustment of the angle of the handle with respect to the axial shaft while providing for positioning the handle radially about the axis of the shaft extension.

3. An adjustable handle as claimed in claim 1 wherein said index wheel means is a wheel having apertures spaced about its periphery and the means for releasably engaging the index wheel means is a pin on the connector.

4. An adjustable handle as claimed in claims 1, 2 or 3 wherein the connector means is comprised of a top wall, a bottom wall and a pair of side walls defining a wedge shaped cavity and an aperture through which the shaft extension projects.

5. An adjustable handle as claimed in claim 4 wherein the resilient means is a helical spring through which the shaft extension extends so as to be held in place by retaining means on an end of the shaft extension.

6. An adjustable handle as claimed in claim 5 where the means on the connector for releasably engaging the index wheel means is a first pin on a first wall and a second pin on a second wall which are dimensioned so as to be received in the apertures in the index wheel means.

7. An adjustable handle as claimed in claim 6 wherein the first and second pins are integrally formed on the connector.

8. A paint roller comprising an adjustable handle, a paint roller cover of synthetic sponge material, a tubular support for the roller cover, an axial shaft having spaced apart support disks, a shaft angularly disposed to the axial shaft, a wheel mounted for rotation on the angular shaft, an integral shaft extension parallel to an outer face of the tubular support, an index wheel secured to the shaft extension, a connector secured to the handle and rotatably mounted on the shaft extension, means for urging the connector toward the index wheel means, so that the position of the handle relative to rollers can be changed by moving the connector relative to the index wheel means.

* * * * *